US008347932B2

(12) United States Patent
Kalwara et al.

(10) Patent No.: US 8,347,932 B2
(45) Date of Patent: Jan. 8, 2013

(54) ROOF SEAM TAPE APPLICATOR

(75) Inventors: Joseph John Kalwara, Indianapolis, IN (US); John Heathcote, Columbus, IN (US); Brandon Jay Ward, Brownsburg, IN (US); Jeffrey W. Henegar, Westfield, IN (US)

(73) Assignee: Firestone Building Products Company, LLC, Indianapolis, IN (US)

( * ) Notice: Subject to any disclaimer, the term of this patent is extended or adjusted under 35 U.S.C. 154(b) by 258 days.

(21) Appl. No.: 12/771,437

(22) Filed: Apr. 30, 2010

(65) Prior Publication Data

US 2010/0269981 A1 Oct. 28, 2010

Related U.S. Application Data

(63) Continuation-in-part of application No. 11/350,609, filed on Feb. 9, 2006, now abandoned.

(60) Provisional application No. 60/742,546, filed on Feb. 9, 2005.

(51) Int. Cl.
*E04D 15/00* (2006.01)

(52) U.S. Cl. ..... 156/577; 221/186; 221/188

(58) Field of Classification Search ..... 156/577; 221/186, 188

See application file for complete search history.

(56) References Cited

U.S. PATENT DOCUMENTS 3,617,424 A * 11/1971 Smith ..... 156/577
3,880,701 A 4/1975 Moree
4,196,028 A 4/1980 Mills et al.
4,243,468 A 1/1981 Boyd
4,452,663 A 6/1984 Heaton
4,460,433 A 7/1984 Boyd
4,572,072 A 2/1986 Jeschke
4,581,091 A 4/1986 Lane
4,648,935 A 3/1987 Brown et al.
4,869,044 A 9/1989 Wald
4,913,766 A 4/1990 Lojdstrom
4,923,559 A 5/1990 Kennedy et al.
5,254,203 A 10/1993 Corston
5,290,390 A 3/1994 Roman et al.
5,342,466 A 8/1994 Eidson
5,439,540 A 8/1995 Lippman et al.

(Continued)

OTHER PUBLICATIONS

Technical Information Sheet, Firestone QuickTaper (TM) dated Jan. 7, 2010, 1 page.

(Continued)

*Primary Examiner* — Mark A Osele
*Assistant Examiner* — Nickolas Harm
(74) *Attorney, Agent, or Firm* — Jason A. Houser; Arthur M. Reginelli

(57) ABSTRACT

An apparatus for placement of seam tape to a roof or roof membrane. The apparatus comprises first and second sides spaced a distance apart, wherein each side includes a material axle opening and a pressure applicator orifice. The apparatus also comprises a removable pressure applicator having a first end and second end positioned in the pressure applicator orifices of the first and second sides. A support element may be operatively attached to the first and second sides, span the distance between the first and second sides, and positioned opposite the pressure applicator to support the apparatus. Additionally, a material axle may be positioned such that its ends are removably positioned in the material axle openings of the first and second sides. A closed front side may connect the first and second side, while an open stern may allow direct access to the pressure applicator, the support element, and the material axle.

26 Claims, 11 Drawing Sheets

U.S. PATENT DOCUMENTS

| | | | |
|---|---|---|---|
| 5,462,633 | A | 10/1995 | Manusch et al. |
| 5,545,287 | A | 8/1996 | Carlson |
| 5,641,378 | A | 6/1997 | Luhman et al. |
| 6,209,609 | B1 | 4/2001 | Edwards et al. |
| 6,302,177 | B1 | 10/2001 | Gruber |
| 6,540,002 | B1 | 4/2003 | Edwards et al. |
| 6,684,926 | B2 | 2/2004 | Matechuk |
| 6,915,828 | B2 | 7/2005 | Takeuchi et al. |
| 6,973,951 | B2 | 12/2005 | Henegar |
| 7,028,941 | B2 | 4/2006 | Ibrahim et al. |
| 2006/0226168 | A1 | 10/2006 | Henegar |

OTHER PUBLICATIONS

Technical Information Sheet, Carlisle's SecurTaper, undated, 1 page.

* cited by examiner

ROOF SEAM TAPE APPLICATOR

This application is a Continuation-in-Part of U.S. Non-provisional application Ser. No. 11/350,609 filed on Feb. 9, 2006, which claims the benefit of U.S. Provisional Application No. 60/742,546, filed Feb. 9, 2005, which Applications are incorporated herein by reference in their entirety.

FIELD OF THE INVENTION

The present invention relates generally to adhesive applicators. More particularly, the present invention relates to an apparatus for the placement of seam tape to a roof, a roofing membrane, or to a membrane used with a low-slope roof, the apparatus may be described as a roofing seam tape applicator.

BACKGROUND OF THE INVENTION

It will be appreciated by those skilled in the art that commercial equipment is available to apply roofing seam tape to a single ply membrane surface. Such conventional systems have been generally designed to lay material on a roof that comes in roll form and is applied in sheet form. These prior art pieces of equipment have ranged from the effective but complicated to the ineffective.

Some conventional systems require an elaborate routing of the rolled material through the conventional system as it is applied to the roof. Other forms of conventional pieces of equipment that utilize modified bitumen torch applied material have required platforms and implementation of heat in order to properly lay the sheet material on the roof.

Additionally, conventional applicators for sheet material on rooftops do not allow for direct viewing of the application of the sheet material to the roof. In these conventional pieces of equipment, the elements of the equipment themselves block the view of an operator of the conventional equipment.

These other prior art attempts fail to provide a simple roofing seam tape applicator that facilitates easy alignment of the roofing tape onto the roof in the proper position and then allows the machine to be loaded with the roll of material for further application of the seam tape to the roof.

Additionally, the prior art attempts have had difficulty in applying proper pressure to the tape across the full width of the tape. The inconsistencies may arise by improper balancing of the weight of the conventional applicators. Additionally, the conventional applicators traditionally lack the ability to adjust to imperfections in the roofing surface. As such, a proper adhesion or bond is not realized.

What is needed then is a roofing seam tape applicator that facilitates the proper alignment of the seam tape to a roof, or a membrane on the roof deck. Additionally, the applicator could include cushioned supports and pressure elements used to place the seam tape on the roof, or roofing membrane, and follow the contours of the roof when they are irregular. This type of roofing seam tape applicator is lacking in the art.

SUMMARY OF THE INVENTION

Disclosed herein is an apparatus for placement of seam tape to a roof. The apparatus comprises first and second sides spaced a distance apart, wherein each side includes a material axle opening and a pressure applicator orifice. The apparatus also comprises a removable pressure applicator having a first end and second end positioned in the pressure applicator orifices of the first and second sides. A support element may be operatively attached to the first and second sides, span the distance between the first and second sides, and positioned opposite the pressure applicator to support the apparatus.

Additionally, a material axle may be positioned such that its ends are removably positioned in the material axle openings of the first and second sides. A closed front side may connect the first and second side, while an open stern may allow direct access to the pressure applicator, the support element, and the material axle. Additionally a tension element may be positioned approximately below one of the material axle openings to maintain a level of pressure on a roll of material positioned on the material axle. A handle may be rotatively fixed to the first and second sides for imparting horizontal momentum to the apparatus.

The pressure applicator may include a deflecting axle positioned to removably secure the pressure applicable orifice of the first and second sides. Alternately, the pressure applicator orifice may be shaped into a slotted opening that may be notched to accept the pressure applicator and to removably secure the pressure applicator in the pressure applicator orifice of the first and second side.

Also, the apparatus may include at least one handle stop attached to at least one of the first or second sides to restrict rotational movement of the handle. Additionally, the material axle may include material guides removably positioned on a material axle to align the roll of material on the material axle.

The pressure applicator may be comprised of a weighted cushion material used to provide pressure for the application of the seam tape to the roof wherein the surface of the roof is uneven. The hardness of the weighted cushion material may vary across the length of the pressure applicator. For example, each end of the pressure applicator may include a hardness that is greater than the hardness of a middle section of the pressure applicator. The middle section may substantially span the length of the pressure applicator.

The pressure applicator may include a rotatable release liner take-up roll secured to the handle to collect the release liner of the adhesive tape as it is applied. The release liner take-up roll may include a crank arm to facilitate manual rotation thereof, or may be rotationally coupled to the support element or pressure applicator to cause automated rotation thereof while the device is pushed across a surface. A mechanism may also be provided to prevent unwinding of the release liner take-up roll.

BRIEF DESCRIPTION OF THE DRAWINGS

FIG. 2 shows the pressure applicator removed to facilitate alignment of the roll of material.

FIG. 3 shows the pressure applicator reassembled after alignment of the material to facilitate further application of the material.

DETAILED DESCRIPTION OF ILLUSTRATIVE EMBODIMENTS

Figure 1:
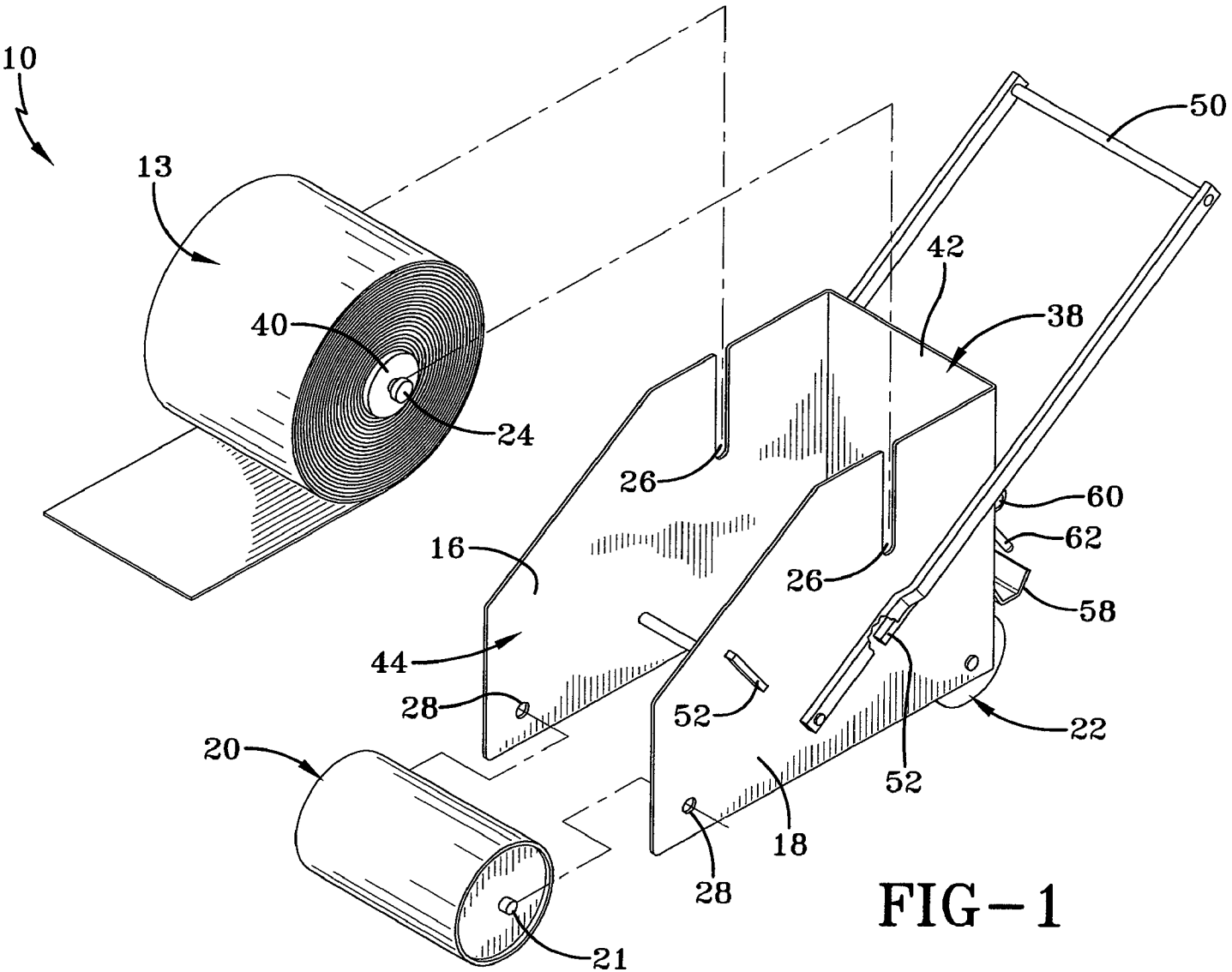
FIG. 1 is a front perspective view of an embodiment of the current invention.
Figure 2:
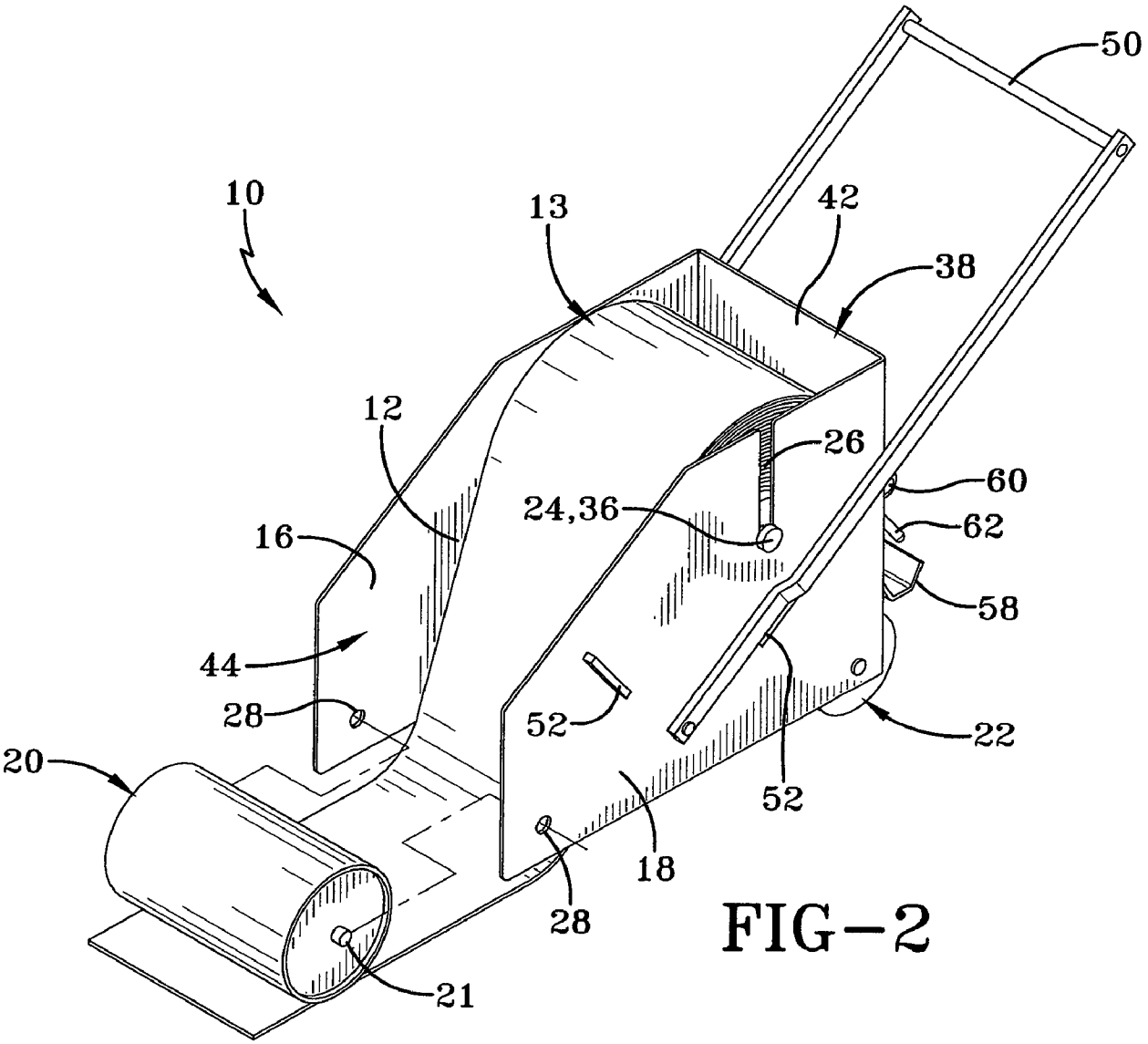
FIG. 2 is a perspective view of the embodiment as shown in FIG. 1.
Figure 3:
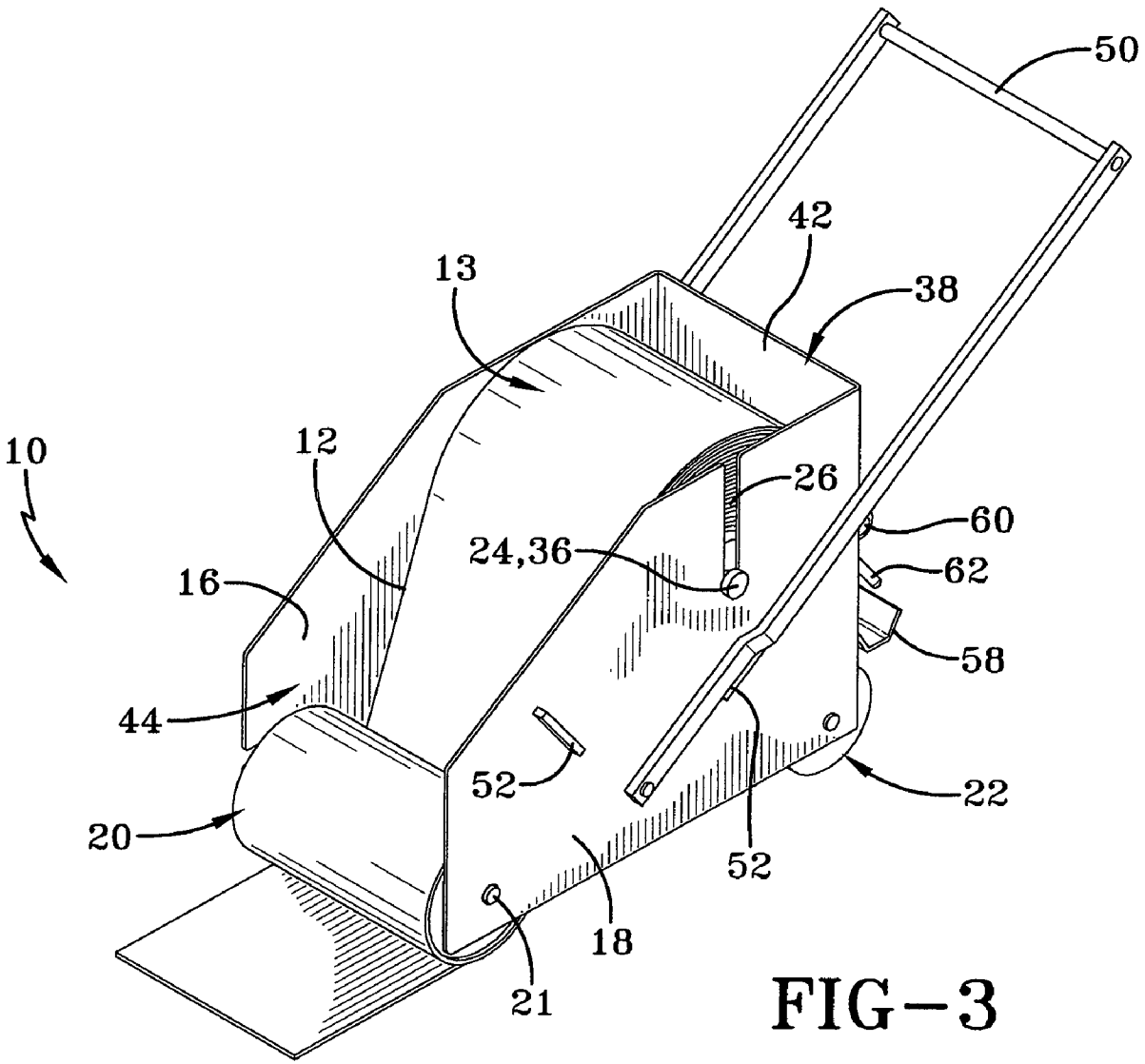
FIG. 3 is a perspective view of the embodiment shown in FIGS. 1-2.
Figure 4:
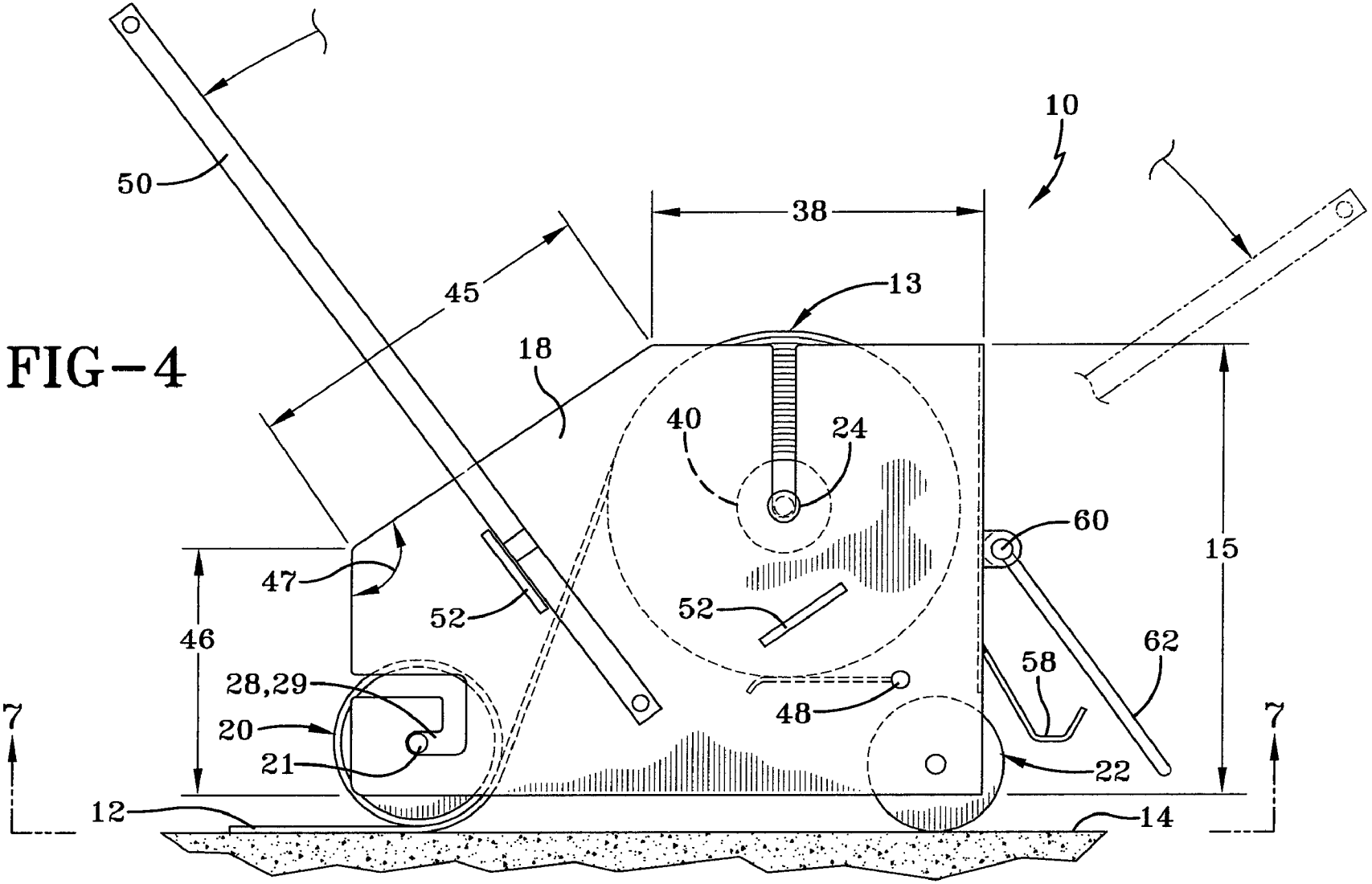
FIG. 4 is a side view of one embodiment of the current invention.
Figure 5:
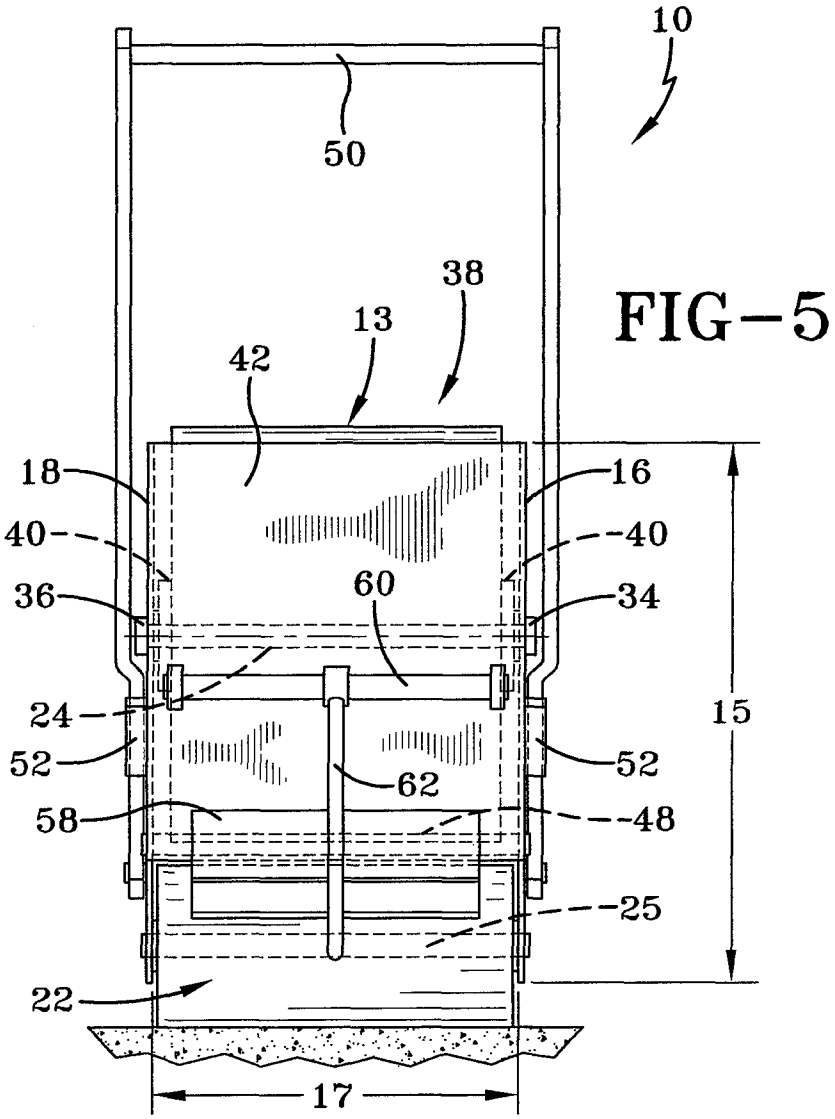
FIG. 5 is a front view of the embodiment shown in FIG. 4.
Figure 6:
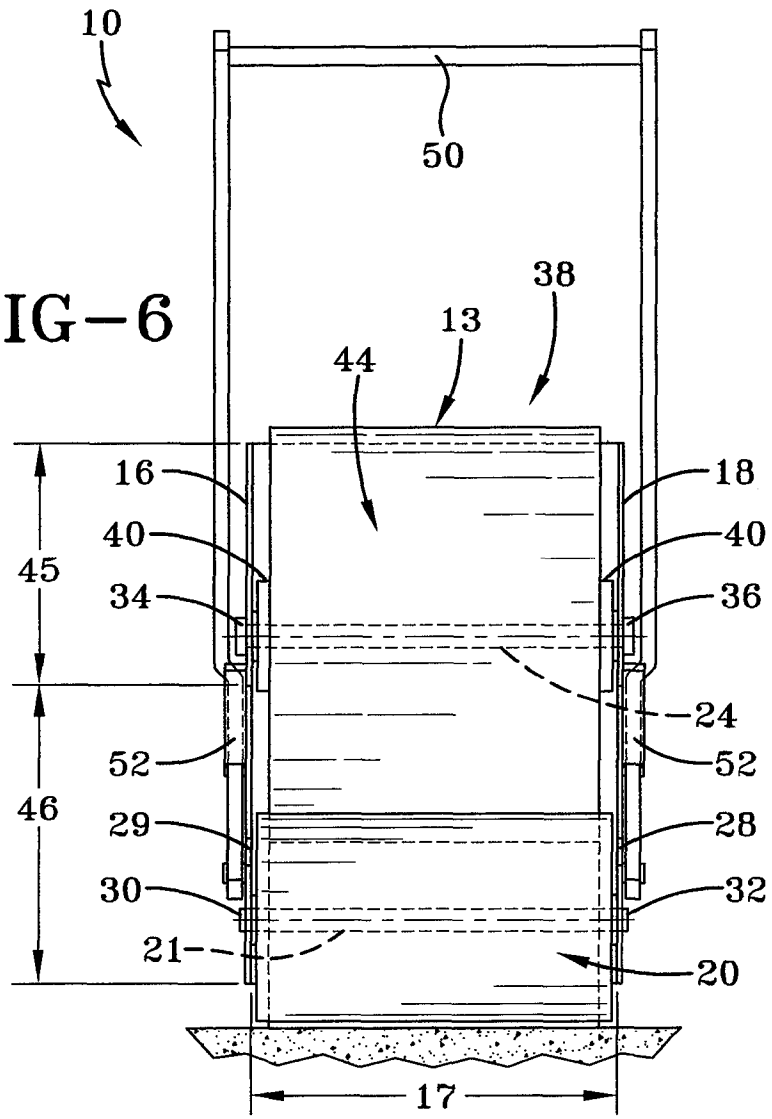
FIG. 6 is a back view of the embodiment shown in FIGS. 4-5.
Figure 7:
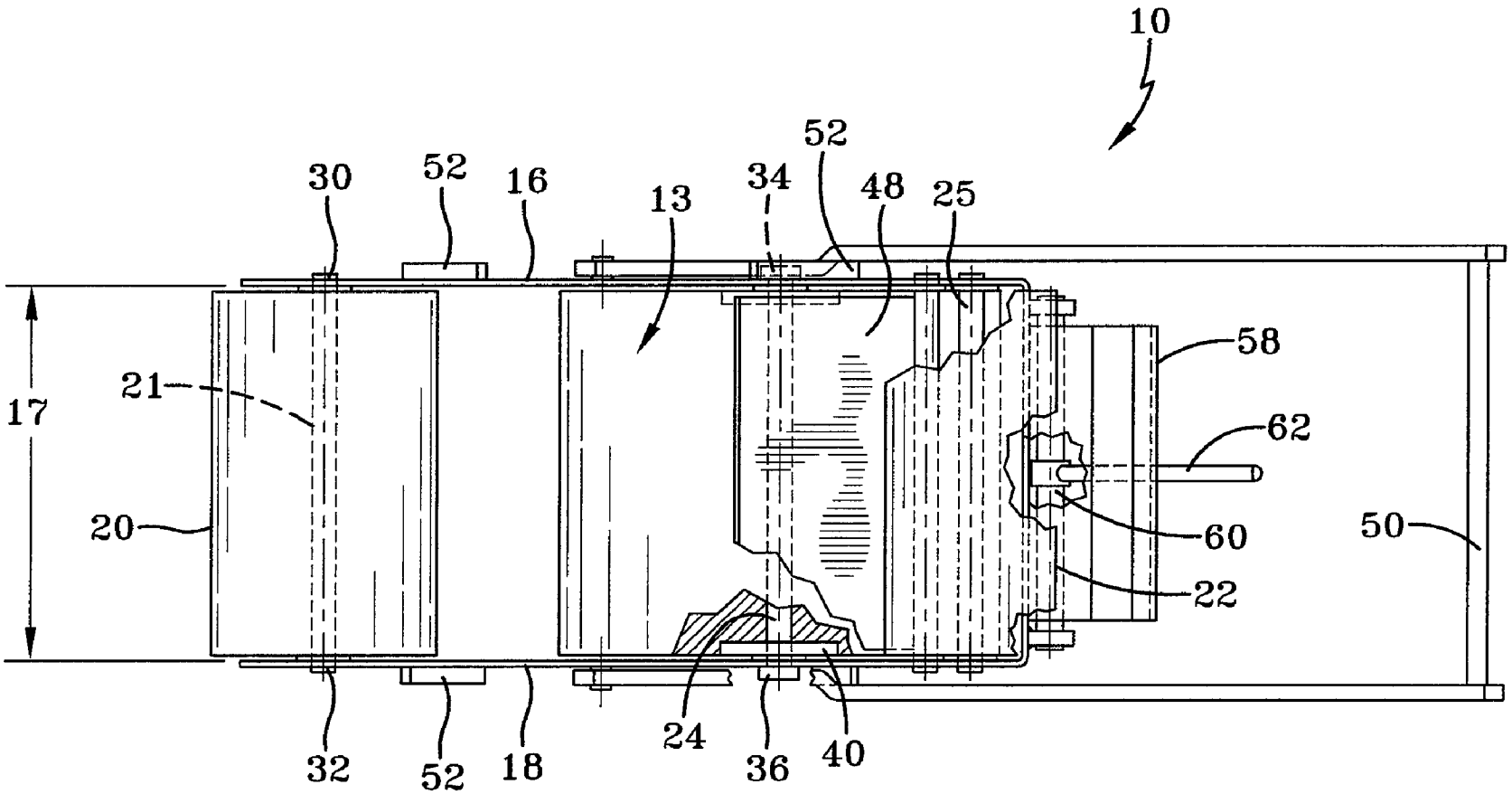
FIG. 7 is a bottom view of the embodiment shown in FIGS. 4-6.
Figure 8:
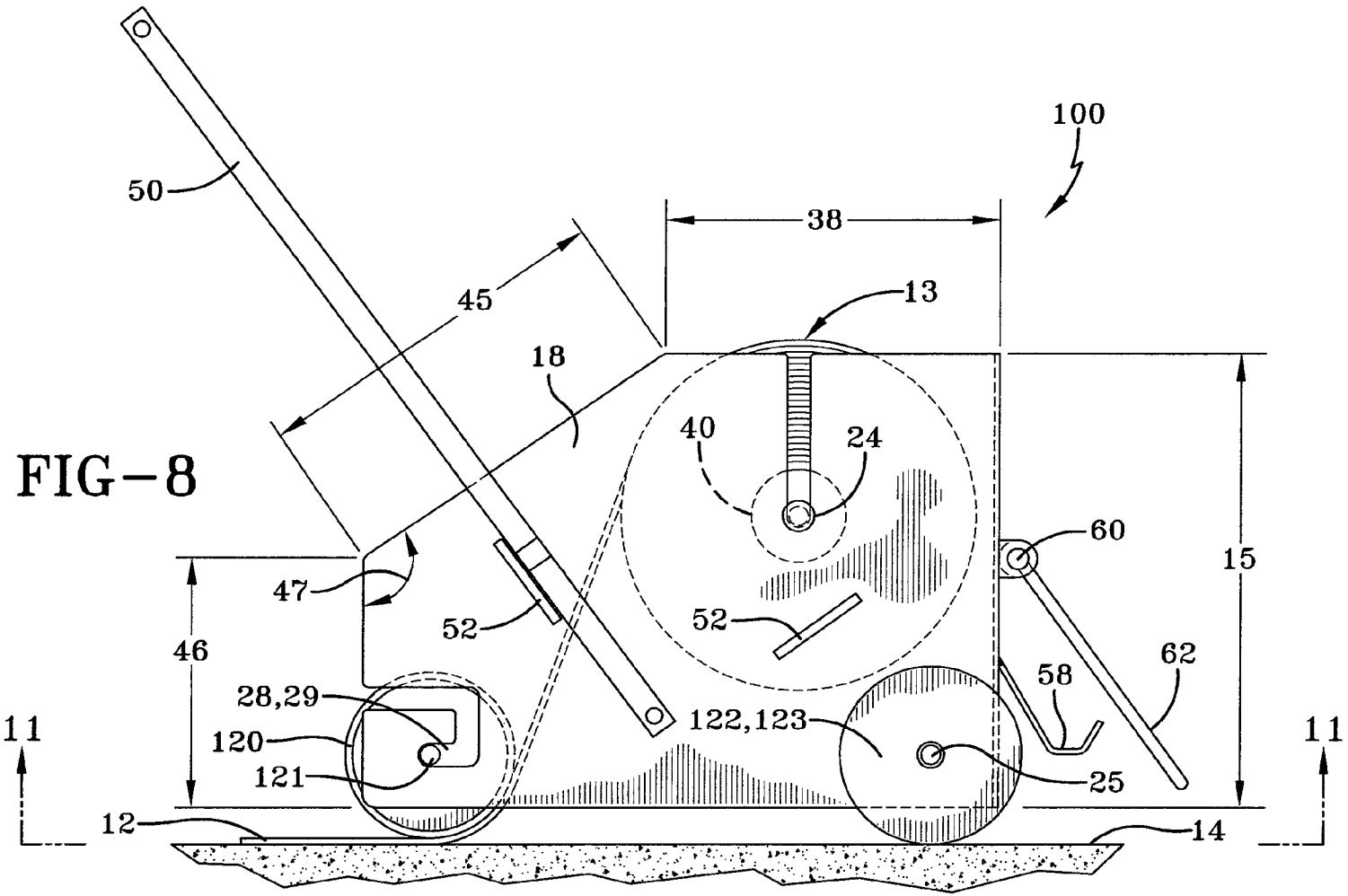
FIG. 8 is a side view of an alternate embodiment of the current invention.
Figure 9:
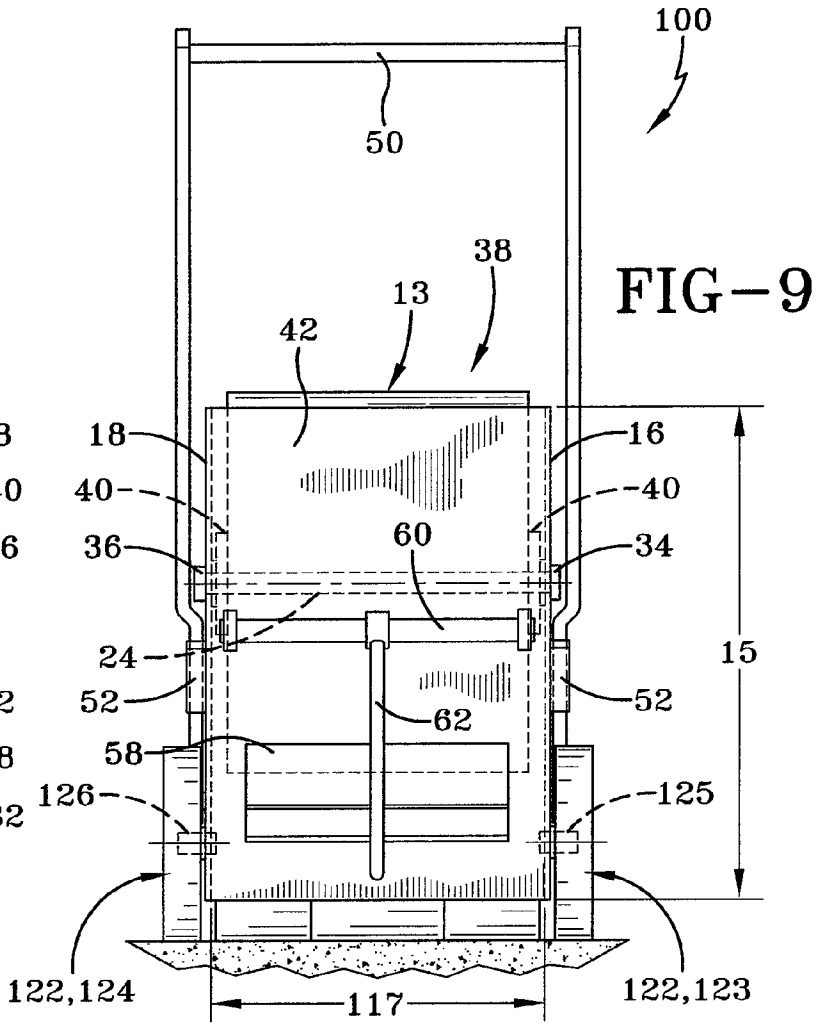
FIG. 9 is a front view of the alternate embodiment shown in FIG. 8.
Figure 10:
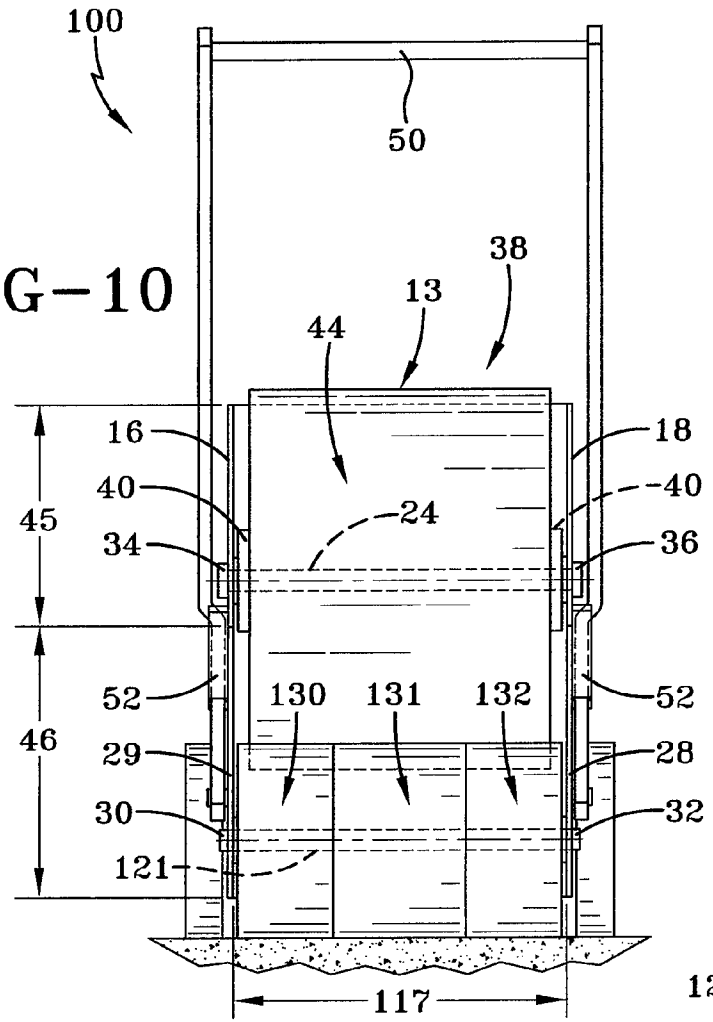
FIG. 10 is a back view of the alternate embodiment shown in FIGS. 8-9.
Figure 11:
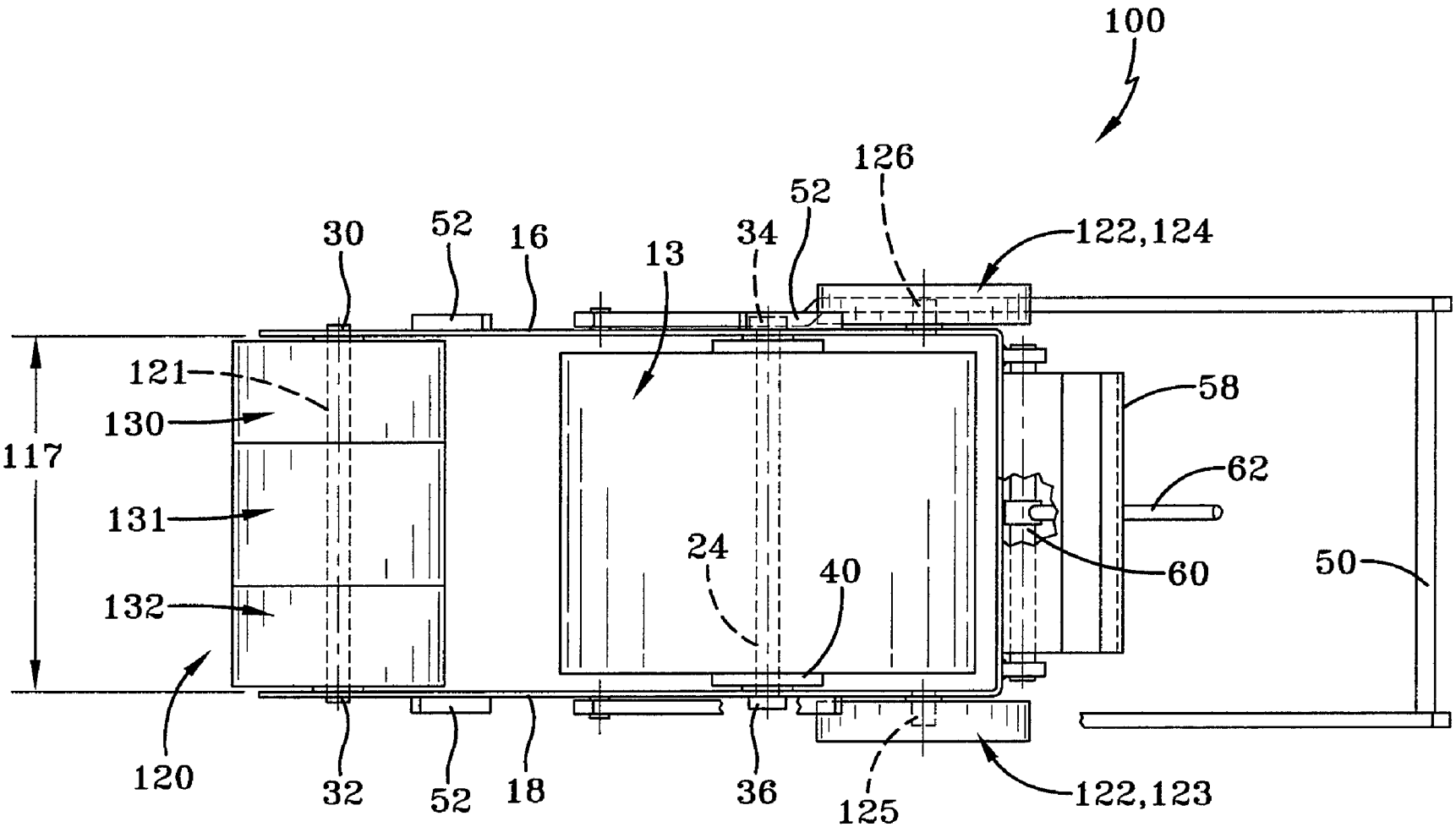
FIG. 11 is a bottom view of the alternate embodiment shown in FIGS. 8-10.

Referring generally now to FIGS. 1-7, a first embodiment of the apparatus of the current invention is shown and generally designated by the numeral 10. The apparatus (10) is for the placement of material (12) to a surface (14), while in a preferred embodiment the apparatus (10) may be used as a roofing seam tape applicator. The apparatus (10) comprises a first side (16), a second side (18), a removable pressure applicator (20), a support element (22), and a material axle (24).

In certain embodiments, the apparatus (10) may be utilized to apply an adhesive tape to a roofing membrane. The adhesive tape may be a solid adhesive, which may also be referred to as a solid adhesive strip, and may include those that are conventional in the art. In one or more embodiments, the adhesive tape may include EPDM and/or butyl rubber. In the same or other embodiments, the adhesive tape includes at least 85% solids. In one or more embodiments, the adhesive tape includes a thickness of greater than 0.007 inches (0.178 mm). In other embodiments, the adhesive tape includes a thickness greater than 0.01 inches (0.25 mm). In still other embodiments, the adhesive tape includes a thickness greater than 0.1 inches (2.54 mm).

Useful adhesive tapes are disclosed in U.S. Pat. Nos. 6,120,869, 5,888,602, 5,859,114, 5,733,621, 5,612,141, 5,563,217, 5,545,685, 5,504,136, 5,242,727, 4,932,171, 4,849,268, 4,657,958, 4,855,172, 4,588,637, 4,539,344, and 4,426,468, which are incorporated herein by reference. Useful tapes are commercially available including those available under the trade names QuickSeam™ (Firestone), PLIOSEAL™ (Ashland), 510™ (ADCO), 505™ (ADCO). In one or more embodiments, the adhesive tape applied by apparatus (10) may include a release liner on one surface thereof. The release liner is designed to cover and protect one surface of the adhesive tape, and is adhered thereto by virtue of the tackiness or adhesive properties of the adhesive tape. The release liner may include any liner material known to those skilled in the art.

In one or more embodiments, the apparatus (10) may be utilized to apply a tape laminate to a roofing membrane. In one or more embodiments, the tape laminate may include a flashing layer and an adhesive tape layer. In certain embodiments, the flashing layer may be a thermoset or thermoplastic flashing layer. In certain embodiments, the flashing layer may be EPDM based. The adhesive tape layer of the tape laminate may include any of the adhesive tapes discussed herein, and may optionally include a release liner on a surface of the adhesive tape opposite the flashing layer. In one or more embodiments, the adhesive tape layer and the flashing layer may have approximately the same width. In other embodiments, the adhesive tape layer may have a width that is greater than the width of the flashing layer of the tape laminate.

The first and second sides (16 and 18) of the apparatus (10) may be spaced a distance (17) apart, which may also be described as a width (17). Preferably the distance (17) is a distance suitable to accommodate the width of the material (12). The first and second sides (16 and 18) may include a material axle opening (26) and a pressure applicator orifice (28), which may also be described as a pressure roll aperture (28) or a pressure roll channel (28).

The pressure applicator (20), which may also be described as a removable pressure roll (20), includes a first pressure applicator end (30) positioned in the pressure applicator orifice (28) of the first side (16). The pressure applicator (20) also includes a second applicator end (32) positioned in the pressure applicator orifice (28) of the second side (18). The ends (30 and 32) may be positioned in the pressure applicator orifices (28) such that they may be secured and removed by a user of the apparatus (10). Alternately described, the pressure applicator (20) may be removably secured to the pressure applicator orifices (28) through the use of the first and second pressure applicator ends (30 and 32).

The pressure applicator (20) may include an axle (21) that may be positioned in the pressure applicator orifice (28) to securely and removably engage the pressure applicator orifice (28) of the first and second sides (16 and 18). The axle (21) may be positioned in the orifices (28) through an axial defection. The axle (21) may be compressed and inserted between the sides (16 and 18) and then released to extend beyond the width (17) of the apparatus (10). In this embodiment, the axle (21) may be compressed or deflected axially to fit between the first and second sides (16 and 18) such that the axle (21) may be removably secured to the pressure applicator orifice (28).

Alternately, the pressure applicator orifice (28) may include a slotted opening (29) that may be notched to accept the pressure applicator (20) such that the slotted opening (29) removably secures the pressure applicator (20) to the pressure applicator orifice (28) of the first and second sides (16 and 18). The slotted opening (29) may be shaped to provide the proper resistance and securement to the pressure applicator (20) in order to secure the pressure applicator (20) to the first and second sides (16 and 18). The slotted opening (29) may be sized to provide a frictional fit to the pressure applicator (20) or to the axle (21) to secure the pressure applicator (20) to the first and second sides (16 and 18). In a preferred embodiment the slotted opening (29) may be described as being generally "J shaped."

The support element (22), which may also be described as a guide roll (22), may be operatively attached to the first and second sides (16 and 18) such that the support element (22) spans the distance (17). The support element may be located on support axle (25). Additionally, the support element (22) may be positioned opposite the pressure applicator (20) to support the apparatus (10). The support element (22) may be fixed to the first side (16) or second side (18). Alternately, the support element (22) may be removably secured to at least one of the first or second sides (16 and 18).

As seen in FIGS. 8-11, in an alternate embodiment of the apparatus (100) the support element (122) may comprise a plurality of individual supports (123 and 124). These individual supports (123 and 124) may be attached to the outside of the first and second sides (16 and 18) and rotate about support axles (125 and 126). Alternately, the individual supports (123 and 124) may be attached to the inside of the first and second sides (16 and 18).

The material axle (24), which may also be described as a tape axle (24), may include a first material axle end (34) removably positioned in the material axle opening (26) of the first side (16). Additionally, the material axle (24) may include a second material axle end (36) removably positioned in the material axle opening (26) of the second side (18). Preferably the material axle opening (26), which may also be described as a tape axle aperture (26) or a tape axle channel (26), extends down from the open top (38) of the apparatus (10). This positioning may facilitate the placement of a roll (13) of material (12) in the apparatus (10). Alternately, the material axle opening (26) may be a depression, orifice, or the like positioned in the first side (16) or second side (18) to removably secure the material axle (24) to the apparatus (10), including a Johnson and Johnson brand material axle retaining element.

The material axle (24) may further include material guides (40) that may be removably positioned on the material axle (24) to align the roll (13) of material (12) on the material axle (24). In a preferred embodiment the material guides (40) may be slidably positioned along the length of the material axle (24) to allow for variances in the size of the roll (13).

Preferably the material axle opening (26) may be positioned between and above the pressure applicator (20) and support element (22). Alternately described, the material axle opening (26) may support the material axle (24) and the roll (13) of material (12) in a position that is horizontally oriented between the pressure applicator (20) and support element (22) while being vertically above the pressure applicator (20) and support element (22).

The apparatus (10) may also include a front side (42) connecting the first side (16) to the second side (18). The front side (42) is preferably closed and may be described as a front plate connecting the first and second sides (16 and 18). Preferably the front plate (42) may span the distance (17) between the first side (16) and second side (18) and may substantially span the height (15) of the apparatus (10).

Additionally, the apparatus (10) may include an open stern (44), which may also be described as an open back (44), that allows direct access to and easy removal of the pressure applicator (20). Additionally the open stern (44) may provide direct access to the support element (22), the material axle (24), and the roll of material (13). Direct access to an element of the apparatus (10) may be defined as an unobstructed view of the element to be accessed. The open stern (44), direct access to the roll of material (13), and the easy removal of the pressure applicator (20) may facilitate the placement and alignment of the material (12) to the surface (14), as will be subsequently described. The open stern (44) may include a top stern portion (45) and a bottom stern portion (46). The top stern portion (45) and bottom stern portion (46) may meet at angle (47) to further facilitate the alignment of the material (12) to the surface (14) through the reduction in side obstructions in to the applicator. This provides greater access to and viewing of the roll of material (13) and the material (12) that is to be placed on the surface (14).

The apparatus (10) may further comprise an optional tension element (48) positioned to maintain a level of pressure in the roll (13) of material (12) as positioned on the material axle (24). The tension element (48) may be positioned approximately below the material axle opening (26). This positioning may use the effects of gravity on the roll (13), in combination with the pressure inducing feature of the tension element, to maintain the level of pressure. The tension element (48) may also be described as being positioned to maintain a level of tension in the roll (13), or positioned to restrict rotational movement of the roll (13). The tension element (48) may span the distance (17) between the first side (16) and second side (18). This facilitates the maintenance of a level of pressure on the roll (13) across the width of the roll (13) and restricts the unintentional unwinding of the roll (13) during operation of the applicator (10). In a preferred embodiment the tension element (48) may be a spring loaded pressure plate.

In other embodiments, restriction of unintentional unwinding of the role (13) may be provided by material axle ends (34, 36). Specifically, first material axle end (34) may frictionally contact first side (16) and second material, axle end (36) may frictionally contact second side (18). Ends (34, 36) may be adjustable in the axial direction to provide frictional resistance to axle (24) rotation. In one or more embodiments, ends (34 and 36) may include bolts or screws, which are received in threaded holes (not shown) at the ends of axle (24).

The apparatus (10) may also include a handle (50) rotatively fixed to at least one of the sides (16 or 18). The handle (50) may be used to transmit horizontal momentum to the apparatus (10) from a user (not pictured) of the apparatus (10). Preferably the handle (50) may be rotatively attached to both the first and second sides (16 and 18).

Additionally, the apparatus (10) may include at least one handle stop (52) attached to at least one of the sides (16 or 18) to restrict the movement of the handle (50). The handle stop (50) may also be described as restricting the rotational motion of the handle (50). In a preferred embodiment the apparatus (10) may include two handle stops (52) positioned on each side (16 and 18) such that the handle stops (52) may limit the rotational movement of the handle (50) in both rotational directions.

Additionally, in one or more embodiments the apparatus (10) may include a tilt stand (58) positioned on front plate (42). An operator may tilt the apparatus (10) to a resting position. In the resting position, apparatus (10) is supported by tilt stand (58) and support element (22). In this manner, pressure applicator (20) is raised away from surface (14) allowing for the placement and alignment of material (12). Additionally, while in the resting position, pressure applicator (20) may be easily accessed and removed.

Apparatus (10) may also include a tape edge guide (62) which may be positioned for movement on a guide shaft (60). Tape edge guide (62) may slide laterally on shaft (60). Tape edge guide (62) may also pivot about shaft (60). Thus, in this manner tape edge guide (62) may be positioned at a desired orientation by an operator. The desired orientation may be maintained by a set screw or the like. Tape edge guide (62) may be used as a visual reference point by an operator to ensure proper tape alignment.

The open top (38), open stern (44), tape edge guide (62), and pressure applicator (20) facilitate visual confirmation of the alignment of the material (12) to the surface (14). Additionally, the open stern (44) and the removable feature of the pressure applicator (20) facilitate alignment of the material (12) to the surface (14) independent of the engagement between the pressure applicator (20) and the material (12). Alternately stated, the pressure applicator (20) may be removed to allow alignment of the material (12) to the surface (14). In a preferred embodiment, this removal coupled with the open characteristic of the stern (44) facilitates alignment of the material (12) to the surface (14). After alignment of the material (12), the pressure applicator (20) may be repositioned in the material opening (26) in the pressure applicator orifice (28) to then used to apply pressure to the material (12) to apply the material (12) to the surface (14). As such the apparatus (10) facilitates proper placement of the material (12) without an obstructed view of the material (12) or complicated material (12) routing through the apparatus (10).

In a preferred embodiment the pressure applicator (20) may comprise a weighted cushioned material. The weighted cushion material may provide pressure for the application of the material (12) to the surface (14). The weighted cushion material facilitates this application of material when the surface (14) is uneven, due to the fact that the weighted cushion material may adapt to undulations and depressions in the surface (14) while still applying the proper pressure to the material (12) to apply to the surface (14). Alternately, the support element (22) may be comprised of weighted cushion material to conform to the imperfections in the surface (14) as the support elements (22) traverses the surface (14).

As seen in FIGS. 8-11, in a more preferred embodiment the apparatus (100) comprise a pressure applicator (120) that varies in hardness along the length (121) of the pressure applicator (120). This may also be described as varying in malleability along the length (121) of the pressure applicator (120). This longitudinal variance in hardness of the pressure applicator may be on the surface of the pressure applicator or throughout the pressure applicator. Alternately, various radial distances from a central axis along a cross section of the pressure applicator may comprise various levels of hardness.

The pressure applicator (120) includes end portions (130 and 132) that may be harder than the middle portion (131) of the pressure applicator (120). This variance in hardness facilitates a proper application of the material (12) to the surface (14). The middle portion (131), which may be described as a middle section (131) is preferably softer than the end portions (130 and 132). This make up allows the middle portion (131) to deform about imperfections in the surface (14) while still allowing the end portions (130 and 132) to maintain adequate contact between the material (12) and the surface (14) for proper application of the material (12) to the surface (14).

In a preferred embodiment, the middle portion (131) includes a hardness between 5 and 35 as measured by a Shore A Durometer, while the end portions (130 and 132) include a hardness between 10 and 70 as measured by a Shore A Durometer.

In a most preferred embodiment, the middle portion (131) includes a hardness between 15 and 25 as measured by a Shore A Durometer, while the end portions (130 and 132) include a hardness between 20 and 50 as measured by a Shore A Durometer.

In other embodiments, the pressure applicator (100) may include end portions (130 and 132) and a middle portion (131) that may be independently rotatable. In one or more embodiments, applicator portions (130, 131, 132) may be separated and exhibit the same malleability.

Figure 12:
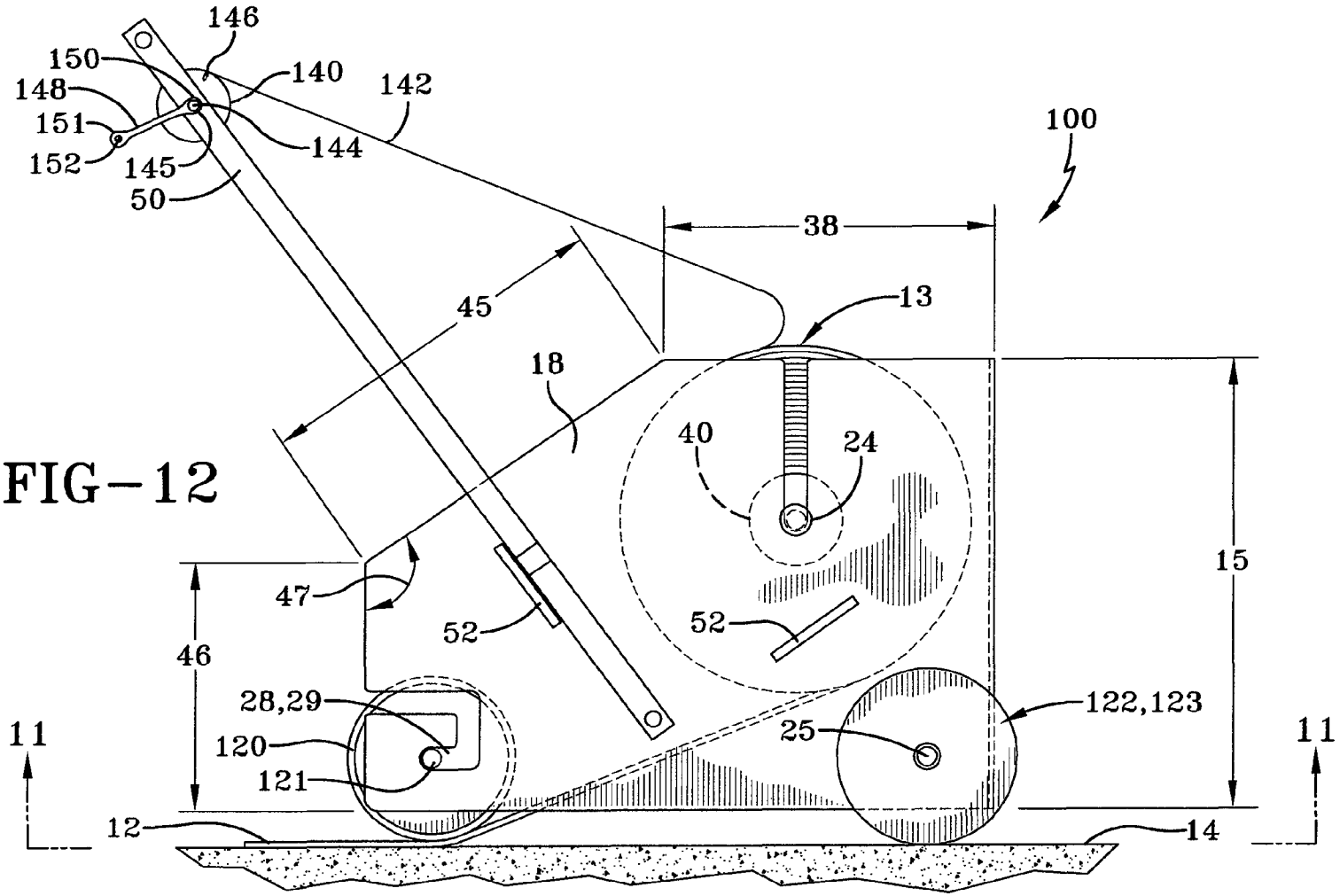
FIG. 12 is a side view of another alternate embodiment of the current invention.
Figure 13:
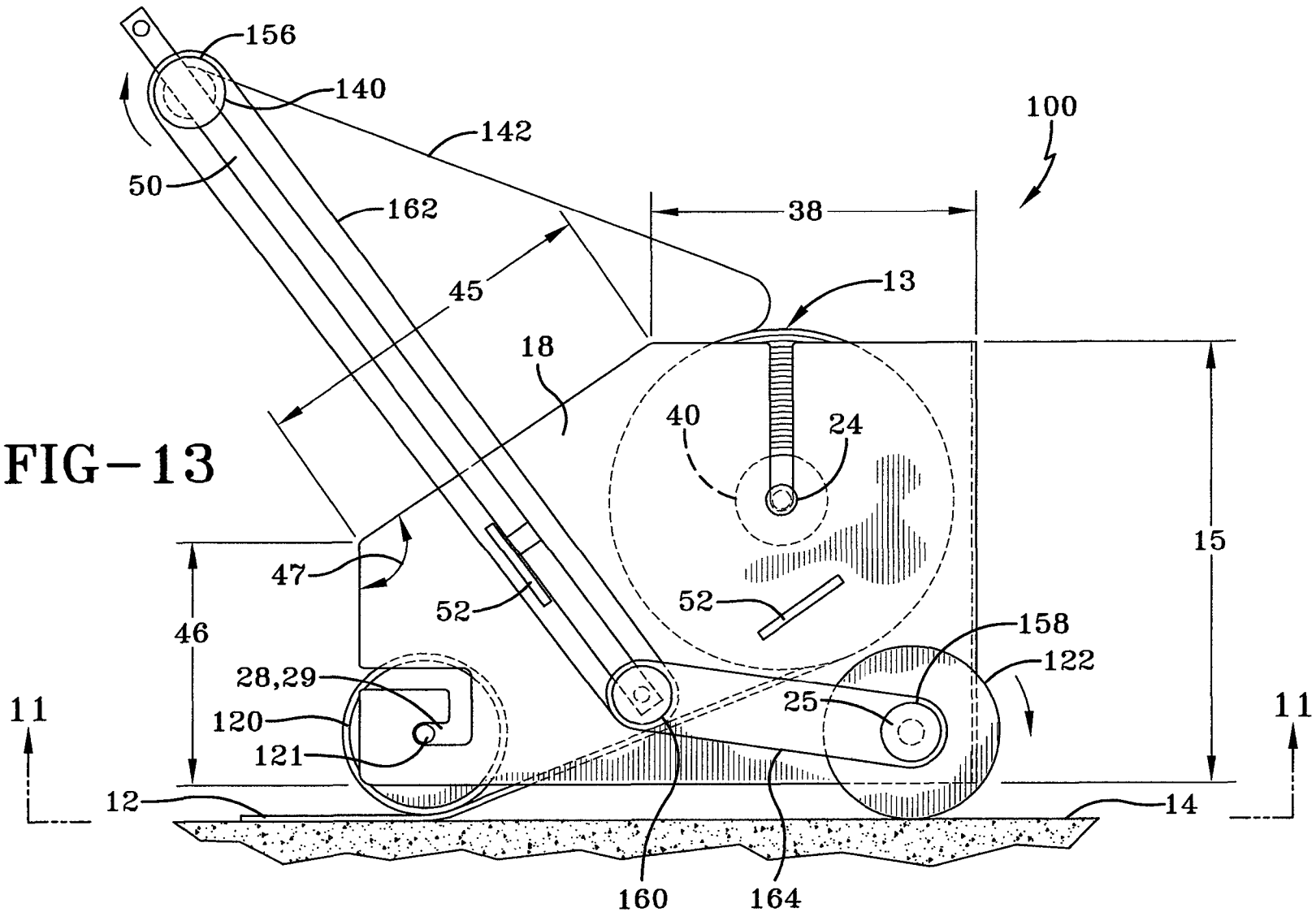
FIG. 13 is a side view of yet another alternate embodiment of the current invention.

In one or more embodiments, and as shown in FIGS. 12 and 13, the pressure applicator (100) may include a release liner take-up roll (140) that is adapted to collect and carry a release liner (142) provided on the material (12). In one or more embodiments, the release liner take-up roll (140) may be rotatably secured to handle (50) by any method or mechanism known to those skilled in the art. For example, release liner take-up roll (140) may include a bore therethrough (not shown), and the handle (50) may include a release liner take-up roll axle extending therefrom (not shown). The release liner take-up roll axle may be received in the bore through the release liner take-up roll (140) to rotatably secure the release liner take-up roll (140) to the handle (50). In other embodiments, release liner take-up roll (140) may include journals (144) extending from each end that are rotatably received in apertures (145) in the handle (50).

In one or more embodiments, the release liner take-up roll (140) may include a mechanism for rotatably securing the release liner (142) thereto. The mechanism for securing the release liner (142) may be any mechanism known to those skilled in the art suitable for the purpose. For example, the connecting mechanism may include clamps, clips, fasteners or adhesives. In one particular embodiment, a notch (146) is provided along the longitudinal length of release liner take-up roll (140) that receives an end of the release liner (142). In certain embodiments, the notch (146) may include projections therein extending inwardly from alternating sides of the notch to secure the release liner (142) therein. It will be appreciated by those skilled in the art that after release liner (142) has been wound around release liner take-up roll (140) several times, the tension on the wound release liner and friction between the adjacent wound layers will maintain the release liner (142) on the release liner take-up roll (140). In one or more embodiments, release liner take-up roll (140) may also include a mechanism to prevent rotation in an "unwinding direction." For example, a ratchet and pawl mechanism (not shown), which is well known to those skilled in the art, may be provided at one end of release liner take-up roll (140) to prevent the release liner (142) from unwinding from the release liner take-up roll (140).

In one or more embodiments, release liner take-up roll (140) may include a crank arm (148) extending from one end to facilitate manual rotation of the release liner take-up roll (140), as shown in FIG. 12. The crank arm (148) is rotatably secured to release liner take-up roll (140) to transfer rotational forces thereto. The crank arm (148) may include a first end (150) and a second end (151), the first end (150) being rotatably secured to a journal (144) of the release liner take-up roll (140), and the second end (151) having an extension (152) to facilitate gripping the crank arm (148).

In an alternate embodiment, and as shown in FIG. 13, release liner take-up roll (140) may be rotationally coupled to the pressure applicator (120) or support element (122). While the embodiment depicted in FIG. 13 includes a release liner take-up roll (140) rotationally coupled to the support element (122), a person of ordinary skill in the art will appreciate that the device may be modified so that the release liner take-up roll (140) is coupled to the pressure applicator (120). The rotational coupling causes release liner take-up roll (140) to rotate as the pressure applicator (100) is pushed along a surface.

In one or more embodiments, a first pulley (156) may be rotationally secured to one end of the release liner take-up roll (140), and a second pulley (158) may be rotationally secured to one end of the support element (122). It is contemplated that, as shown in FIG. 13, an intermediate pulley (160) may be rotationally secured to a side (16 or 18) or the handle (50). A first belt (162) may rotationally couple the first pulley (156) to the intermediate pulley (160), and a second belt (164) may rotationally couple the intermediate pulley (160) to the second pulley (158). This arrangement of belts and pulleys allows the first belt (162) to be positioned along the length of the handle (50), thereby ensuring that it does not present an obstacle to operation of the pressure applicator (120). It is also contemplated that a belt may be positioned over the first pulley (156) and the second pulley (158) to directly rotationally couple the two pulleys together. In an alternative embodiment, the pulleys (156, 158, 160) may be replaced by sprockets and the belts (162, 164) may be replaced by chains to rotationally couple the release liner take-up roll (140) to the support element (122).

Operation of the Apparatus

The apparatuses (10 or 100) may be loaded and operated as follows. A roll (13) of material (12) may be placed on a material axle (24). Material guides (40) then may be positioned to properly place the roll (13) on the material axle (24), if needed. A portion of the material (12) may be gathered from the roll (13). This portion of material (12) may be properly aligned to the surface (14) to which it is to be applied.

Next the material axle (24) including the roll (13) of material (12) may be positioned in the material axle openings (26) of the first and second sides (16 and 18). Then the pressure applicator (20) may engage the material (12) such that it applies pressure to the material (12). Next the pressure applicator (20) may be positioned in the pressure applicator orifice (28) to secure the pressure applicator (20) in its proper position on the apparatus (10). The handle (50), which could be rotated away from this loading area during the aforementioned process, may then be rotated back to allow a user (not shown) of the apparatus (10) to impart horizontal movement to the apparatus (10). If a release liner take-up roll (140) is provided on the handle (50), the release liner (142) may then be secured to the release liner take-up roll (140) to facilitate winding of the release liner (142) as the pressure applicator (120) is rolled over material (12) on surface (14).

This alignment of the material (12) and loading of the roll (13) may be facilitated by the open stern (44) and open top (38). This is due to the fact that visual confirmation of the alignment and placement of the material (12) may be facilitated by the open stern (44) while placement of the material axle (24) containing a roll (13) of material (12) may be facilitated by the open top (38).

One or more embodiments of the present invention are directed toward a method for applying a thermoset or thermoplastic membrane (e.g., EPDM membrane) to a rooftop by employing the apparatus of one or more embodiments of this invention. According to one or more of these methods, a first membrane sheet is secured to a rooftop. This can be accomplished by employing mechanical fasteners including those that are conventional in the art. Once a first membrane is secured to the rooftop, the tape applicator of one or more embodiments of this invention can be positioned near an edge of the membrane at a location where it is desirable to apply the seam tape. Once positioned over a desired location on the membrane, the apparatus of the present invention can be employed to apply a seam tape to the first membrane by employing one or more of the operating procedures described herein. Once the seam tape has been applied to the first membrane, a second membrane may be positioned over the seam tape (i.e., overlapping the first membrane) and secured thereto by applying pressure to the top of the second membrane. As a result of practicing this method, a water impervious seam can be constructed between the membrane. In one or more embodiments, a primer may be applied to the first membrane prior to application of the seam tape. Likewise, a primer can be applied to the underside of the second membrane prior to contacting the second membrane with the seam tape.

Various modifications and alterations that do not depart from the scope and spirit of this invention will become apparent to those skilled in the art. This invention is not to be duly limited to the illustrative embodiments set forth herein.

What is claimed is:

1. A roofing tape applicator for the placement of adhesive tape laminates to a surface comprising:

a first side;

a second side spaced a distance from the first side;

a removable pressure roll operatively attached to the first and second sides;

a guide roll spaced from and positioned opposite the pressure roll and operatively attached to the first and second sides;

an open back allowing removal of the pressure roll;

a tape axle extending between said first and second sides above said pressure roll and said guide roll;

a handle rotatably secured to said first and second sides; and a release liner take-up roll rotatably secured to said handle, wherein said release liner take-up roll is rotationally coupled to one of said pressure roll and said guide roll, thereby causing said release liner take-up roll to rotate as said tape applicator is rolled across a surface and wherein a first pulley is rotationally secured to said release liner take-up roll, a second pulley is rotationally secured to said guide roll, and a belt is positioned around said first and second pulleys to transfer rotational forces therebetween.

2. The tape applicator of claim 1, wherein a crank arm is operatively connected to said release liner take-up roll to facilitate manual rotation of the take-up roll.

3. The tape applicator of claim 1, wherein the handle includes at least one aperture, and the release liner take-up roll includes at least one journal, the journal being received in said aperture to rotatably secure the release liner take-up roll to the handle.

4. The tape applicator of claim 3, wherein the release liner take-up roll includes a longitudinally extending notch.

5. The tape applicator of claim 1, wherein said first and second sides each include an aperture, said tape axle being received in said apertures.

6. The tape applicator of claim 5, further including tape axle ends on opposing sides of said tape axle, said tape axle ends including a first end and a second end, said first end being in frictional contact with said first side and said second end being in frictional contact with said second side, wherein said tape axle ends are axially adjustable.

7. The tape applicator of claim 1, wherein said pressure roll includes end portions and a middle portion and said end portions comprise harder material than said middle portion.

8. The tape applicator of claim 7, wherein each of said end portions and said middle portion are separate components of said pressure roll.

9. The tape applicator of claim 7, wherein each of said end portions and said middle portion are independently rotatable.

10. The tape applicator of claim 1, further comprising at least one material guide slidably positioned on the tape axle.

11. A roofing tape applicator for the placement of adhesive tape laminates to a surface comprising:

a first side;

a second side spaced a distance from the first side;

a removable pressure roll operatively attached to the first and second sides;

a guide roll spaced from and positioned opposite the pressure roll and operatively attached to the first and second sides;

an open back allowing removal of the pressure roll;

a tape axle extending between said first and second sides above said pressure roll and said guide roll;

a handle rotatably secured to said first and second sides;

a release liner take-up roll rotatably secured to said handle, wherein said release liner take-up roll is rotationally coupled to one of said pressure roll and said guide roll, thereby causing said release liner take-up roll to rotate as said tape applicator is rolled across a surface, and wherein a first sprocket is rotationally secured to said release liner take-up roll, a second sprocket is rotationally secured to said guide roll, and a chain is positioned around said first and second sprockets to transfer rotational forces therebetween.

12. The tape applicator of claim 11, wherein a crank arm is operatively connected to said release liner take-up roll to facilitate manual rotation of the take-up roll.

13. The tape applicator of claim 11, wherein the handle includes at least one aperture, and the release liner take-up roll includes at least one journal, the journal being received in said aperture to rotatably secure the release liner take-up roll to the handle.

14. The tape applicator of claim 11, wherein the release liner take-up roll includes a longitudinally extending notch.

15. The tape applicator of claim 11, wherein said first and second sides each include an aperture, said tape axle being received in said apertures and further including tape axle ends on opposing sides of said tape axle, said tape axle ends including a first end and a second end, said first end being in frictional contact with said first side and said second end being in frictional contact with said second side, wherein said tape axle ends are axially adjustable.

16. The tape applicator of claim 11, wherein said pressure roll includes end portions and a middle portion and said end portions comprise harder material than said middle portion and wherein each of said end portions and said middle portion are separate components of said pressure roll.

17. The tape applicator of claim 11, wherein said pressure roll includes end portions and a middle portion and said end portions comprise harder material than said middle portion and wherein each of said end portions and said middle portion are independently rotatable.

18. The tape applicator of claim 11, further comprising at least one material guide slidably positioned on the tape axle.

19. A roofing tape applicator for the placement of adhesive tape laminates to a surface comprising:

a first side;

a second side spaced a distance from the first side;

a removable pressure roll operatively attached to the first and second sides;

a guide roll spaced from and positioned opposite the pressure roll and operatively attached to the first and second sides;

an open back allowing removal of the pressure roll;

a tape axle extending between said first and second sides above said pressure roll and said guide roll;

a handle rotatably secured to said first and second sides;

a release liner take-up roll rotatably secured to said handle; and where said take-up roll is operatively connected to an intermediary member, and where said intermediary member is operatively connected to at least one of said pressure roll and said guide roll, thereby causing said release liner take-up roll to rotate as the tape applicator is rolled across a surface.

20. The tape applicator of claim 19, wherein a crank arm is operatively connected to said release liner take-up roll to facilitate manual rotation of the take-up roll.

21. The tape applicator of claim 19, wherein the handle includes at least one aperture, and the release liner take-up roll includes at least one journal, the journal being received in said aperture to rotatably secure the release liner take-up roll to the handle.

22. The tape applicator of claim 19, wherein the release liner take-up roll includes a longitudinally extending notch.

23. The tape applicator of claim 19, wherein said first and second sides each include an aperture, said tape axle being received in said apertures and further including tape axle ends on opposing sides of said tape axle, said tape axle ends including a first end and a second end, said first end being in frictional contact with said first side and said second end being in frictional contact with said second side, wherein said tape axle ends are axially adjustable.

24. The tape applicator of claim 19, wherein said pressure roll includes end portions and a middle portion and said end portions comprise harder material than said middle portion and wherein each of said end portions and said middle portion are separate components of said pressure roll.

25. The tape applicator of claim 19, wherein said pressure roll includes end portions and a middle portion and said end portions comprise harder material than said middle portion and wherein each of said end portions and said middle portion are independently rotatable.

26. The tape applicator of claim 19, further comprising at least one material guide slidably positioned on the tape axle.

* * * * *